US009281550B2

(12) United States Patent
Jannotta et al.

(10) Patent No.: US 9,281,550 B2
(45) Date of Patent: Mar. 8, 2016

(54) WAVE MODE CONVERTER

(71) Applicant: L&J Engineering, Inc., Hillside, IL (US)

(72) Inventors: Louis J Jannotta, Orland Park, IL (US); Jeffrey D Clay, Oakbrook, IL (US)

(73) Assignee: L&J ENGINEERING, INC., Hillside, IL (US)

( * ) Notice: Subject to any disclaimer, the term of this patent is extended or adjusted under 35 U.S.C. 154(b) by 0 days.

(21) Appl. No.: 14/283,482

(22) Filed: May 21, 2014

(65) Prior Publication Data

US 2015/0022287 A1 Jan. 22, 2015

Related U.S. Application Data

(60) Provisional application No. 61/846,709, filed on Jul. 16, 2013.

(51) Int. Cl.
*H01P 1/163* (2006.01)
*H01P 1/16* (2006.01)
*H01P 5/08* (2006.01)

(52) U.S. Cl.
CPC *H01P 1/16* (2013.01); *H01P 1/163* (2013.01); *H01P 5/08* (2013.01); *H01P 5/082* (2013.01)

(58) Field of Classification Search
CPC ..... H01P 1/16; H01P 1/163; H01P 5/08; H01P 5/082
USPC ..... 333/21 R
See application file for complete search history.

(56) References Cited

U.S. PATENT DOCUMENTS

| | | | | |
|---|---|---|---|---|
| 3,646,481 | A | 2/1972 | Den | |
| 4,099,145 | A * | 7/1978 | Boujet | 333/21 R |
| 4,553,112 | A | 11/1985 | Saad et al. | |
| 4,628,287 | A | 12/1986 | Zinger et al. | |
| 4,679,008 | A | 7/1987 | Irzinski et al. | |
| 4,743,918 | A * | 5/1988 | Rannou et al. | 343/895 |
| 4,890,117 | A * | 12/1989 | de Ronde | 343/773 |
| 4,914,443 | A | 4/1990 | Gans et al. | |
| 4,973,924 | A * | 11/1990 | Bergero et al. | 333/21 R |
| 5,030,929 | A | 7/1991 | Moeller | |
| 5,151,673 | A | 9/1992 | Waarren | |
| 5,515,673 | A | 5/1996 | Leclerco et al. | |
| 6,396,440 | B1 * | 5/2002 | Chen | 343/700 MS |
| 6,424,764 | B1 | 7/2002 | Webb et al. | |
| 6,573,803 | B1 | 6/2003 | Ziegner et al. | |
| 2003/0080828 | A1 | 5/2003 | Chambelin et al. | |

(Continued)

FOREIGN PATENT DOCUMENTS

GB 2434922 A 8/2007

OTHER PUBLICATIONS

Yu et al. "High-Performance Circular TE 01-Mode" IEEE Transactions on Microwave Theory and Techniques, vol. 53 No. 12, Dec. 2005.

*Primary Examiner* — Robert Pascal
*Assistant Examiner* — Kimberly Glenn
(74) *Attorney, Agent, or Firm* — Stout, Uxa & Buyan, LLP; Frank J. Uxa

(57) ABSTRACT

Wave mode converters, and methods of using wave mode converters are disclosed. The wave mode converters include a radial waveguide including a generally disk-like structure to receive a radially propagating field derived from rectangular TE10 waveguide mode, and a body including a plurality of spaced apart apertures.

20 Claims, 4 Drawing Sheets

(56) References Cited

U.S. PATENT DOCUMENTS

2003/0174097 A1 9/2003 Holzman
2007/0075801 A1 4/2007 Okano et al.
2008/0136565 A1 6/2008 Paynter
2012/0077447 A1 3/2012 Rofougaran

* cited by examiner

WAVE MODE CONVERTER

RELATED APPLICATIONS

The subject application claims the benefit of and priority to U.S. Provisional Application Ser. No. 61/846,709 filed Jul. 16, 2013, the disclosure of which is hereby incorporated in its entirety herein by reference.

BACKGROUND

The present disclosure relates to wave mode converters and methods of using such converters. In one example, wave mode converters are disclosed for converting rectangular TE10 waveguide mode to circular TE01 waveguide mode.

Circular TE01 waveguide mode may have advantages over rectangular TE10 waveguide mode. For example, circular TE01 waveguide mode may provide lower transmission loss, for example, due to the electric field not be in contact, or having reduced contact, relative to rectangular TE10 waveguide mode in rectangular waveguides, with the walls of the waveguide. In addition. The circular TE01 waveguide mode propagates in pipe, for example, metallic pipe, with scaled or corroded walls with significantly reduced transmission loss as compared to the circular TE11 mode or to the rectangular TE10 mode which relies on the electric field traveling on the surface conductivity of the waveguide.

Circular TE01 waveguides may be useful in many applications. For example, such applications include use in linear accelerators, microwave power transmission, radar level gauging in stilling well and gauge/sampling hatch applications, among other applications well known in the art. In addition, pairs of wave mode converters, for example, the mode converters disclosed herein, may be employed, for example, and without limitation, to make rotary microwave joints for rotating antennas, and microwave devices/sensors in rotating machinery or wheels.

Previous wave mode converters have been relatively complex in structure and/or relatively ineffective in operation and/or relatively expensive to operate and maintain.

Disclosed herein are new wave mode converters which address one or more of the issues, for example, as noted above and/or other issues, relating to previous and current wave mode converters.

SUMMARY

The present disclosure relates to wave mode converters to convert rectangular TE10 waveguide mode to circular TE01 waveguide mode. The wave mode converters disclosed herein are effective and reliable in operation, straightforward in construction, and relatively inexpensive to produce, operate and maintain.

In one example, wave mode converters are disclosed which may be used to generate a circular TE01 waveguide mode, for example, in large diameter overmoded circular pipes. An overmoded circular waveguide may be defined as a pipe greater than a wavelength in diameter and can support one or more higher modes than the TE01 mode.

The wave mode converters to convert rectangular TE10 waveguide mode to circular TE01 waveguide mode disclosed herein may comprise a radial waveguide structured to receive a radially propagating field derived from rectangular TE10 waveguide mode. In one example, the radial waveguide comprises a generally disk-like structure, for example, having a first, for example, upper, surface and a spaded apart opposing second, for example, lower, surface; and a body, for example, a radial waveguide body, having a body surface substantially adjacent, for example, in contact with, the disk-like structure, for example, the second surface of the disk-like structure, and including a plurality of spaced apart apertures.

In one example, the plurality of spaced apart apertures form a ring of apertures.

The apertures, for example, the ring of apertures, may be located substantially around a center of the radial waveguide.

In one example, the plurality of spaced apart apertures extend through the body. In one example, the plurality of apertures do not extend into the generally disk-like structure.

In one example, the number of apertures is at least about 4. In one example, the maximum number of apertures that are present may be the number of parabolic apertures that can fit in a given radius of the radial waveguide while maintaining each aperture separate from the other apertures.

In one example, the number of apertures can be either an odd number or an even number.

In one example, the number of apertures can be increased to purify and/or strengthen the launched TE01 field and/or control the amount of energy-coupled out of the radial waveguide.

The plurality of apertures may be configured so that the radially propagating field traveling radially outward in the disk-like structure of the radial waveguide couples out of, or passes out of, the plurality of apertures and produces an in-phase electric field. In one example, the in-phase electric field is present at adjacent apertures.

In one example, the plurality of apertures produces a ring of concentrated TE01 circular mode.

The configuration, positioning and spacing of the plurality of apertures may be selected to facilitate the conversion of rectangular TE10 waveguide mode to circular TE01 waveguide mode. Each of the plurality of apertures may be shaped differently or substantially identically. In one example, the space or distance between any two adjacent apertures is substantially equal.

The plurality of apertures may be configured or shaped in any suitable configuration or shape to be effective in accordance with the present disclosure. For example, the apertures may be circular, polygonal, rectangular, triangular, V-shaped, ovoid, elliptical, semi-circular, parabolic and the like and combinations thereof. In one example, each of the plurality of apertures is substantially identically shaped and/or substantially identically sized.

In one example, each of the plurality of apertures is substantially in the form of a parabola. Such parabolic apertures or substantially parabolic apertures may be useful in creating and/or to facilitate creating a, desired electrical field in a desired direction or directions.

Each of the apertures, for example, parabolic apertures, may be oriented in substantially the same direction relative to a center of the radial waveguide.

In one example, the plurality of spaced apart parabolic apertures, are structured to create a unified resultant electric field vector that circulates in the direction of the foci of the parabolas formed by the plurality of parabolic apertures.

The radial waveguide may comprise any suitable material or materials of construction or suitable combination of materials of construction. For example, the generally disk-like structure may be made of one or more suitable dielectric materials useful to allow and/or to facilitate the propagation of the radially propagating wave in the generally disk-like structure. Examples of such suitable dielectric materials are well known. Such materials include, without limitation, polymeric materials, such as polytetrafluoroethylene, e.g., Teflon® materials, silicone polymeric materials, other polymeric and non-polymeric dielectric materials and combinations thereof.

With regard to the body of the radial waveguide, the material of construction or combination of materials of construction may be selected so as to make the surface of the inner walls of the radial waveguide body conductive at microwave frequencies. Examples of materials of construction for the body of the radial waveguide include, without limitation, electrically conductive plated plastics, electrically conductive plated ceramics, metals, and the like and combinations thereof.

The radial waveguide may have any suitable configuration, for example, peripheral configuration. For example, the radial waveguide may have a generally circular peripheral configuration.

In one example, the radial waveguide, for example, the generally disk-like structure of the radial waveguide, includes an outer absorber member structured to substantially prevent reflected waves from occurring, that is to substantially prevent waves reflecting from the outer portion of the generally disk-like structure of the radial waveguide toward the center of the generally disk-like structure of the radial waveguide.

The outer absorber member may be tapered. The outer absorber member may be in the form of a ring or ring-like structure placed on the outer peripheral surface, for example, the outer circular peripheral surface, of the generally disk-like structure of the radial waveguide. The outer absorber member, for example, the tapered outer absorber member, may be effective to allow the radial waveguide to be less resonant, for example, substantially non-resonant, and to operate over a wider bandwidth relative to a substantially identical radial waveguide without the outer absorber member.

The outer absorber member may be made of any suitable material of construction or combination of materials of construction effective to allow the outer absorber member to perform as described herein. Examples of useful materials of construction of the outer absorber member may include, without limitation, ferrous and carbon materials impregnated in one or more dielectric materials, such as, without limitation, polymeric materials, such as polytetrafluoroethylene, silicone polymeric materials, other polymeric materials, and combinations thereof.

In one example, the wave mode converter includes a field expansion assembly that couples a circular TE01 waveguide mode from the radial waveguide to a larger overmoded circular waveguide substantially without generation of higher modes.

The field expansion assembly may comprise a conical section positioned in proximity to the radial waveguide. In one example, the field expansion assembly and/or the conical section maybe part of the radial waveguide.

In one example, the conical section may comprise two concentric cones. The conical section may comprise an outer diverging cone and an inner converging cone.

The conical section may be effective in generating and receiving circular TE01 fields and in allowing the conversion of circular TE01 mode to rectangular TE10 mode.

In one example, at least one, for example, both, of length and a diameter of the conical section may be adjustable and/or controllable to provide a proper match to a given overmoded pipe diameter. For example, computer simulation of the mode converter and the overmoded pipe, for example, using computer simulation techniques well known in the art, may be employed to match the conical section, for example, the length and/or diameter of the conical section, to the overmoded pipe, for example, to the diameter and/or length of the overmoded pipe, in question.

In one example, the wave mode converter comprises a waveguide chamber comprising a rounded corner waveguide and a shorted center conductor. The waveguide chamber may be effective to convert the input of a rectangular TE10 waveguide to the coaxial TEM mode. The rounded corners of this rounded corner waveguide may be effective in facilitating the formation of the coaxial TEM mode. The rounded corners may facilitate machining of this rounded corner waveguide.

The shorted center conductor may be tunable, that is may be adjustable or controllable to provide a desired or appropriate rectangular TE10 waveguide mode. The shorted center conductor may comprise a screw with an O-ring seal, for example, an O-ring which, when in place, for example, between the screw and the wall of the waveguide, provides a moisture seal. In one example, the shorted center conductor is tunable, that is adjustable or controllable, by compressing the O-ring to vary gap between a head of the screw and a wall of the waveguide.

The shorted center conductor may include an extension which provides a launch antenna in the generally disk-like structure of the radial waveguide.

In one example, the wave mode converter further comprises a SMA connector, or an equivalent connector, positioned to directly drive the radial waveguide.

The SMA connector, or equivalent connector, may hermitically sealed.

In one example, the wave mode converter may comprise a radome sized, positioned and effective to provide protection against moisture and contaminants entering the plurality of apertures. The radome may be constructed of any suitable material of construction, such as a dielectric material, for example, a dielectric material allowing low or reduced energy loss at microwave frequencies or any useful combination of materials of construction. Specific examples of such suitable materials of construction for the radome include, without limitation, polytetrafluoroethylene, fiberglass, one or more other polymeric materials and ceramics allowing low or reduced loss at microwave frequency, and combinations thereof.

Various examples are disclosed and described above, and in the detailed description, with reference to the drawings herein, and the additional disclosure below. Any feature or combination of features disclosed and/or described herein may be included within the scope of the present invention provided that the features included in any such combination are not mutually inconsistent as will be apparent from the context, this specification, and the knowledge of one of ordinary skill in the art. In addition, any feature or combination of features may be specifically excluded from any example disclosed.

DETAILED DESCRIPTION

Wave mode converters for converting rectangular TE10 waveguide mode to circular TE01 waveguide mode, for example, in overmoded circular waveguides, such as large diameter overmoded pipes, are disclosed. An overmoded circular waveguide is defined as a waveguide, for example, a pipe, which has a diameter greater than a wavelength of the wave passing through the waveguide, e.g., pipe, and can support one or more other electromagnetic modes which are higher than the TE01 mode.

The wave mode converters disclosed may comprise a radial waveguide which is useful in converting rectangular TE10 waveguide mode to circular TE01 waveguide mode.

Figure 1:
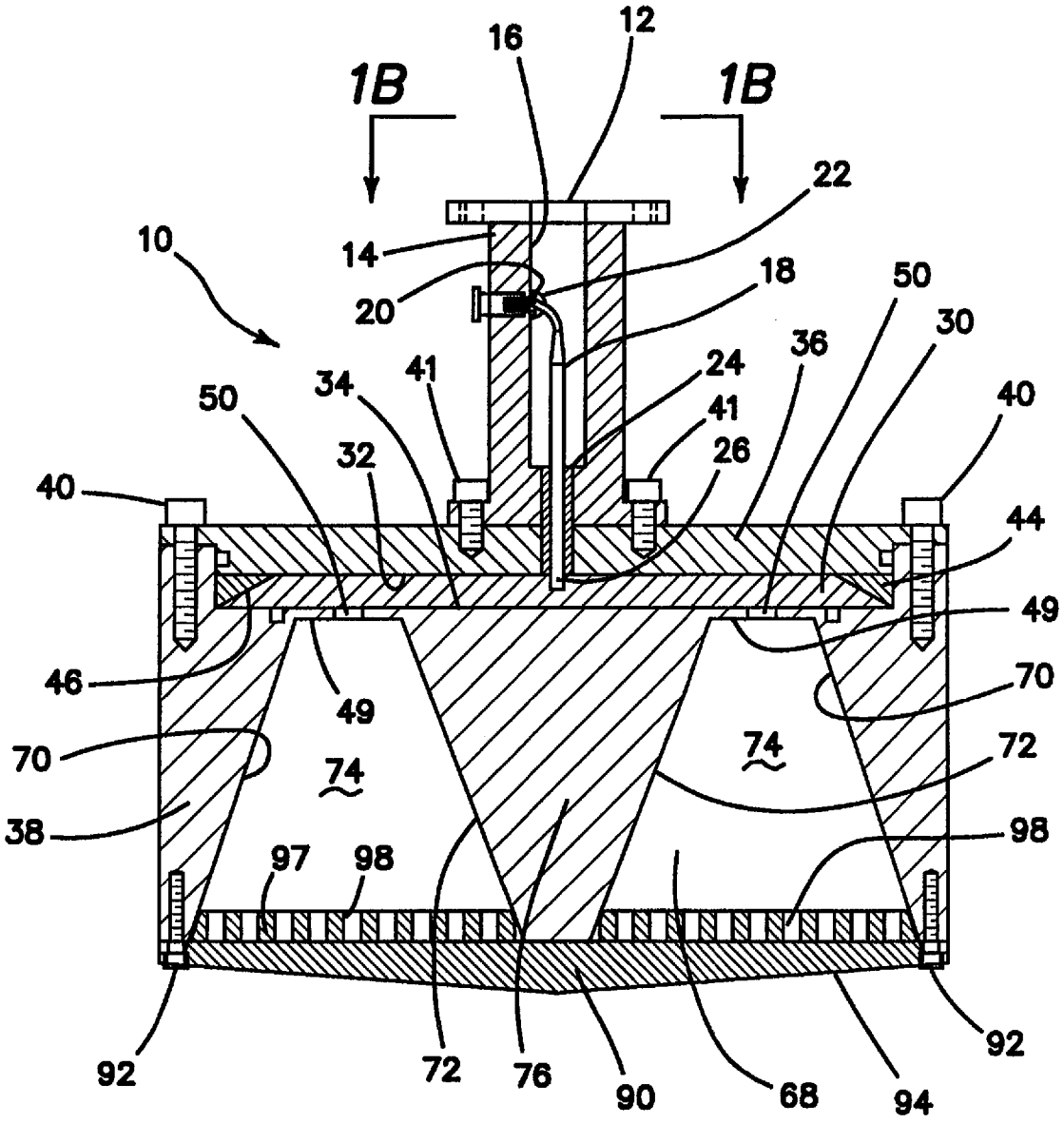
FIG. 1 is a cross-sectional view of a rectangular TE10 to circular TE01 wave mode converter.
Figure 1A:
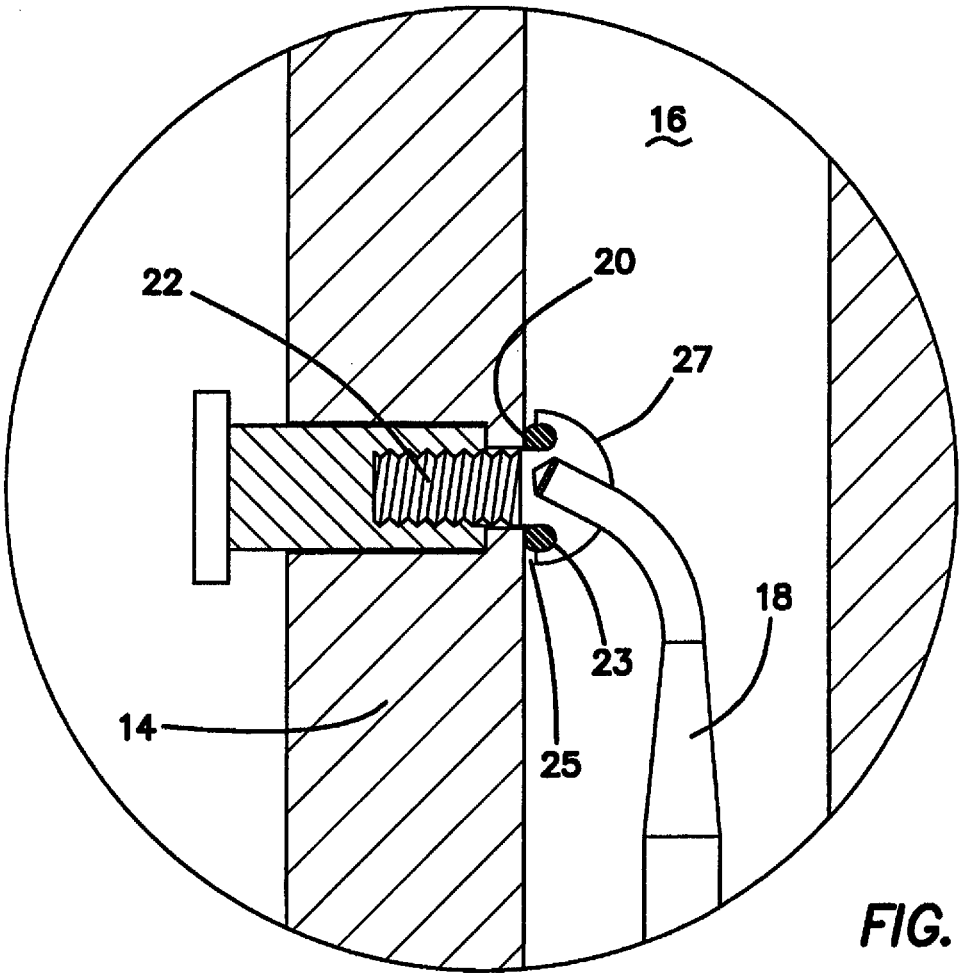
FIG. 1A is an enlarged view of the shorting screw and O-ring assembly shown in FIG. 1.
Figure 1B:
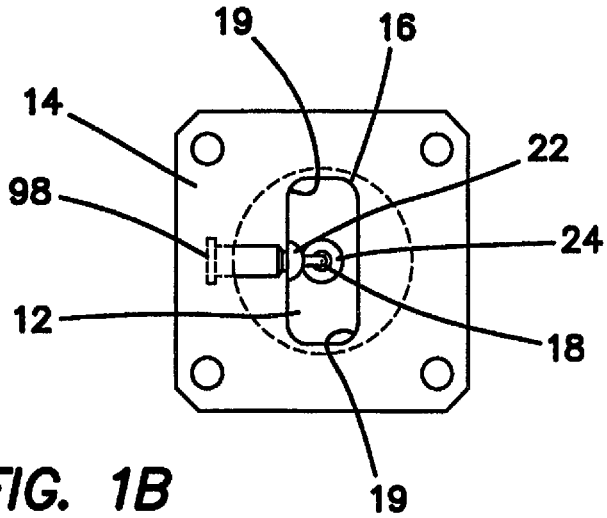
FIG. 1B is a view taken along line 1*b*-1*b* of FIG. 1.

Referring now to FIGS. 1, 1A and 1B, an example of a wave mode converter 10 in accordance with the present disclosure is shown.

In FIG. 1, electrical energy, in rectangular TE10 waveguide mode, is carried into the input 12 of a rectangular waveguide 14. As shown in FIG. 1B, the rectangular waveguide 14 has rounded corners 19 on the rectangular waveguide chamber 16 to facilitate launching the rectangular TE10 waveguide mode on the shorted center conductor 18. Such rounded corners 19 facilitate formation of the coaxial TEM mode, and facilitate machining of waveguide 14.

The short of the shorted center conductor 18 is tunable. In more detail, with reference to FIG. 14, this short is made tunable by using an O-ring 20, for example, made of a polymeric material, such as silicone polymeric materials and the like, that is compressed by a screw 22, for example, made of a metal, such as steel, aluminum and the like, with an O-ring groove 23. The O-ring 20 in the groove 23 allows a small gap 25 to form under the head 27 of the screw, and, in addition, prevents or seals moisture and/or other contaminants from entering the rectangular waveguide chamber 16. The short is tunable by controlling the size of gap 25, for example, by compressing the O-ring to vary the gap, that is the size of the gap 25, between the head of the screw 27 and a wall of rectangular waveguide chamber 16.

The coaxial TEM mode begins to form as the wave propagates down the rectangular waveguide 14 toward the coaxial TEM section 24, shown in FIG. 1. Whet the wave reaches the coaxial TEM section it is traveling in pure or substantially pure coaxial TEM mode.

Upon exiting the coaxial TEM section 24, the wave is launched from launch pin 26, which is an extension of shorted center conductor 18, into disk-like structure 30, which is constructed of a dielectric material, such as poly-tetrafluoroethylene. Thus, the launch pin 26 provides a launch antenna in the radial waveguide.

The disk-like structure 30 is described with reference to FIG. 1.

Disk-like structure 30 has a first or top surface 32 and a substantially opposing second or bottom surface 34. The launch pin 26 extends into the disk-like structure 30 through first or top surface 32.

An electrically conductive top cover 36 is positioned on top of and in contact with disk-like structure 30 and is fastened to an electrically conductive aluminum converter body 38 using screws 40.

Rectangular waveguide 14 is fastened to top cover 36 using screws 41.

The top cover 36 and converter body 38 may be constructed of any suitable material of construction or any suitable combination of electrically conductive materials of construction. Such materials of construction include, without limitation copper, aluminum, stainless steel, plated plastics or ceramics, nickel, monel, gold plating, and combinations thereof. In one example, the top cover 36 and converter body 38 are made of aluminum.

Converter body 38 may be, generally circular in configuration, for example, in outside periphery. For example converter body 38 may have an outside diameter of at least about 1 inch. The outside diameter of the converter body may range from about 1 inch to about 10 inches or more. In one example, the outside diameter may be in a range of about 2 inches to about 8 inches, for example, in a range of about 3 inches to about 7 inches, such as about 5 inches.

The substantially disk-like structure, for example, disk-like structure 30, has an outside diameter which is smaller than the outside diameter of the converter body 38. In one example, the outside diameter of the disk-like structure is in a range of about 0.8 inches to about 9 inches or more. The height or thickness of the disk-like structure may be in a range of less than half of the radial waveguide wavelength. The radial waveguide wavelength is defined by the exciting wavelength divided by the square root of the dielectric value of the disk-like structure 30. The disk-like structure may have other dimensions, e.g., outside diameter and/or thickness, depending on the application involved.

The converter body 38 can be produced using any suitable manufacturing technique. For example, the converter body can be produced by milling, casting, machining, other conventional processing and the like.

With reference to FIG. 1, disk-like structure 30 has a tapered, generally circular periphery 46. Also, as shown in FIG. 1, a tapered absorber member, for example, a tapered microwave absorber member, 44 is positioned on, for example, secured to adhered to or held in place relative to, the tapered generally circular periphery 46 of disk-like structure 30. Absorber member 44 may be useful, for example, in substantially preventing reflected waves from moving back toward the center of the disk-like structure 30. In addition, the absorber member 44 may allow the disk-like structure 30 to be non-resonant and/or to operate over a relatively wide bandwidth.

Figure 3:
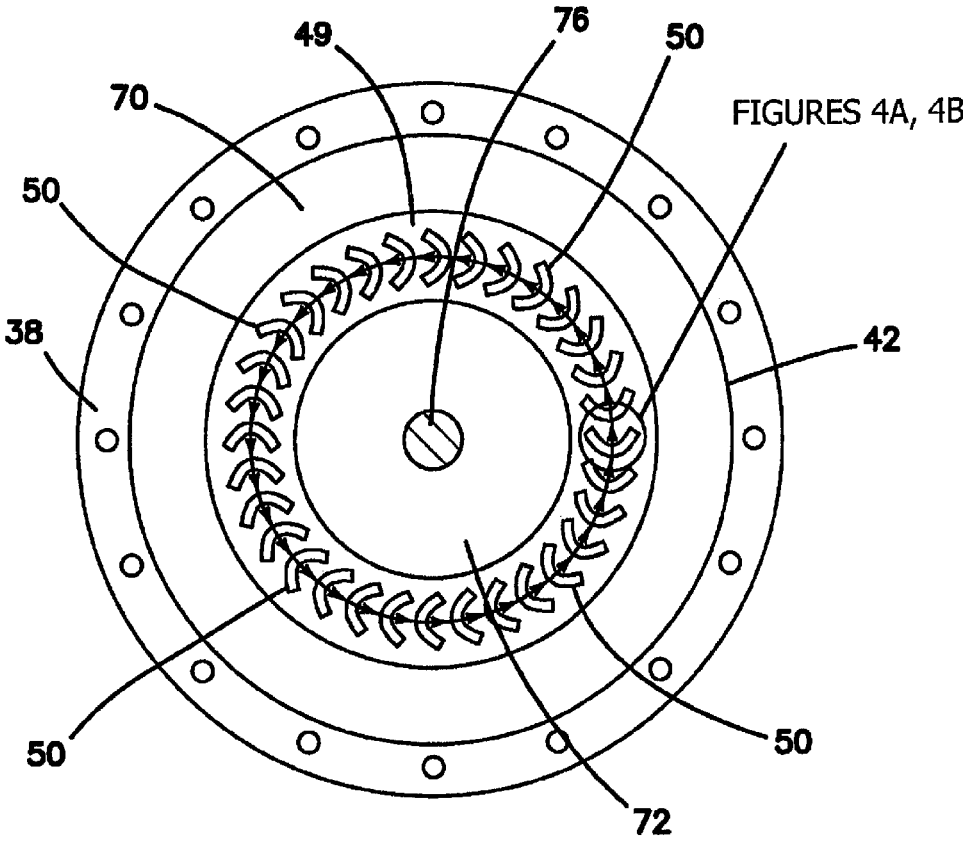
FIG. 3 is a view taken from the bottom of the wave mode converter of FIG. 1, with the radome removed.
Figure 4A:
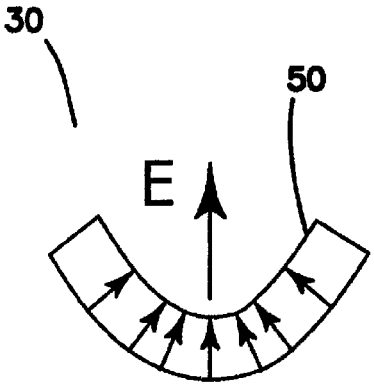
FIG. 4A is an enlarged view of the encircled parabolic aperture in FIG. 3 showing a directed electrical field vector at maximum positive intensity.
Figure 4B:
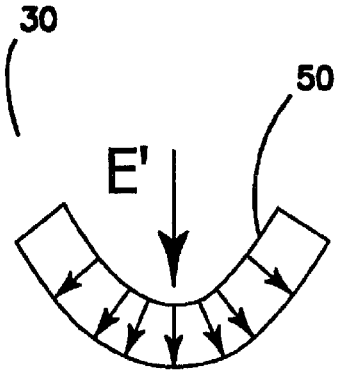
FIG. 4B is an enlarged view of the encircled parabolic aperture in FIG. 3 showing a directed electrical field vector at maximum negative intensity.

With particular reference to FIGS. 3, 4A and 4B, a plurality of parabolic apertures 50 are located in and through the annular body portion 49, which is in contact with disk-like structure 30. Annular body portion 49 is a part of the converter body 38 and the radial waveguide. Annular body portion 49 is relatively thin. For example, annular body portion 49 may be less than about 0.3 inches thick, for example, in a range of about 0.02 to about 0.2 inches thick. In one example, annular body portion 39 is about 0.075 inches thick. The plurality of apertures 50 are present in a circular array around and spaced outwardly from the center of the disk-like structure 30, which has a circular periphery. Each of the parabolic apertures 50 is shaped substantially identically and has a substantially parabolic configuration. The space between any two adjacent parabolic apertures 50 is substantially equal. The apertures are each spaced apart from the other apertures a sufficient distance so as not substantially or significantly interfere with the functioning of any of the apertures.

The parabolic apertures 50 pass through the annular body portion 49 so that each aperture is parallel or substantially parallel to the central vertical axis of the converter body 38, the extension of which axis passes through the center of the disk-like structure 30 between the first or top surface 32 to the second or bottom surface 34 of the disk-like structure.

Further, as shown in FIG. 3, each of the parabolic apertures 50 is oriented in substantially the same direction relative to the central vertical axis of the converter body 38. Each of the parabolic apertures 50 is substantially equally spaced apart from the central vertical axis of the converter body 38.

The number of parabolic apertures may be in a range of about 4 to a maximum number of parabolic apertures that can fit in a given radius of the annular body portion 49 while maintaining each apertures separate or spaced apart from the other apertures or without interfering with the functioning of any of the apertures. In one example, the number of apertures may be in a range of about 4 to about 200 or more, such as in a range of about 4 to about 100 As shown in FIG. 3, the number of parabolic apertures is 32. The number of parabolic apertures may be an even number or an odd number.

In one example, the size and configuration of each of the apertures, e.g., parabolic apertures 50, is selected to facilitate the functioning of the wave mode converter. In one example, each aperture, e.g., parabolic aperture 50, may have a length and a shape, for example, a curvature, that are compatible with, for example, substantially optimized to, the wavelength in the radial waveguide, and a width that is effective in controlling the coupled energy in and out of the radial waveguide.

The parabolic apertures 50 may be formed in the radial waveguide in any suitable manner. For example, and without limitation, the plurality of parabolic apertures 50 can be formed, e.g., cut, in the radial wave guide wall with high speed milling, laser processing, water jet processing, etching, die punch processing, casting processing and the like techniques.

After being launched from the launch pin 26 into the disk-like structure 30, the wave begins propagating in a radial direction outward from the launch pin, which is located substantially at the center of the disk-like structure. The wave travels outward coupling or passing out of the parabolic apertures 50. Any energy, for example, from the wave, that is not coupled or passed out of the parabolic apertures travels to the absorber member 44 where it is dissipated.

As the radial wave cuts or passes out of the parabolic apertures 50 in the annular body portion 49, an alternating electrical field is produced as shown in FIGS. 4A and 4B The resultant electric field in each aperture 50 vectorally adds to a directed electric field vector that changes its direction from maximum positive intensity as shown in FIG. 4A to maximum negative intensity as shown in FIG. 4B. Note that FIGS. 4A and 4B show the range of intensity variation for a single aperture 50.

The plurality of parabolic apertures 50 in a circular array, as described herein, produce a ring of concentrated TE01 circular mode. This is provided, in accordance with the present disclosure, straightforwardly, relatively inexpensively and with reduced transmission losses using the wave mode converter 10.

The ring of concentrated TE01 circular mode may be expanded in a conical section that couples the ring of concentrated TE01 circular mode to a larger overmoded TE01 circular waveguide without, generation of higher modes.

As shown in FIG. 1, such a conical section 68 is located in the converter body 38, and is comprised of two concentric cones: an outer cone defined by walls 70 which diverge, i.e., extend outwardly from the disk-like structure 30; and an inner cone defined by walls 72 which converge, i.e., extend inwardly from the disk-like structure 30. The two cones defined by walls 70 and 72 form an expanding annular space 74 around the central portion 76 of converter body 38.

Conical section 68 may be expanded, for example, in diameter and length, to provide a proper or appropriate match or fit to a given or desired overmoded pipe diameter. The conical section 68 may be capable of generating and receiving circular TE01 fields and allowing the reverse conversion of circular TE01 mode to rectangular TE10 mode. The conical section 68 may be used to allow or provide a bandwidth expansion of the circular TE01 field produced by wave mode converter 10.

The bottom of converter body 38 is covered by a radome 90 which is fastened to the converter body using fasteners (screws) 92. The radome 90 may be made of any suitable material of construction or any suitable combination of materials of construction. Examples of such suitable materials of construction include, without limitation, one or more low loss dielectric materials, such as one or more polymeric materials. In one example, the radome 90 may be made of poly-tetrafluoroethylene.

The radome 90 provides protection from moisture and/or other contaminants entering the parabolic apertures 50 and the conical section 68. In one example, the radome 90 has a substantially smooth outer surface 94 and/or other outer surface which is, easily and effectively cleaned of moisture and/or other contaminants.

The inner portion 97 of radome 90 has a plurality of radial or circular grooves 98 which are structured so as to prevent microwave energy from reflecting from the inside surface of the radome 90.

Figure 2:
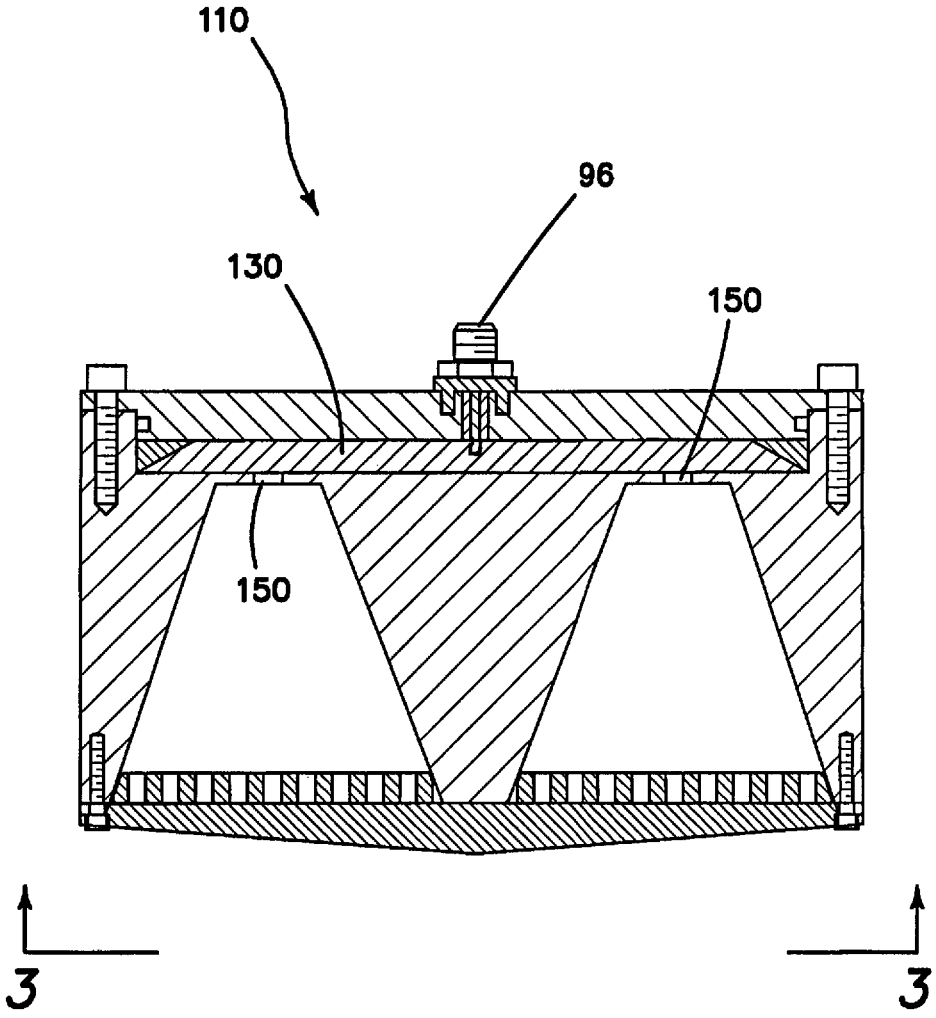
FIG. 2 is a cross-sectional view of another rectangular TE10 to circular TE01 wave mode converter.

FIG. 2 shows an additional wave mode converter 110 in accordance with the present disclosure that, except as expressly described herein, is structured and functions substantially similarly to wave mode converter 10. Features or components of wave mode converter 110 which correspond to features or components of wave mode converter 10 are indicated by the same reference numeral as in describing wave mode converter 10 increased by 100.

The primary difference between wave mode converter 110 and wave mode converter 10 involves, in wave mode converter 110, a SMA or equivalent connector to directly drive the disk-like structure 130.

Thus, in wave mode converter 110, a SMA connector 96, for example, a standard SMA connector, is provided. Such SMA connector directly provides coaxial SMA TEM mode to the disk-like structure 130. In contrast to FIG. 1, in FIG. 2, the Coaxial mode is directly coupled to the disk-like structure 130.

The use of a SMA connector or equivalent allows flexible connection to the antenna from a microwave transceiver. Hermitically sealed SMA connectors can be used and may be effective to prevent moisture from entering the disk-like structure 130. A sealed SMA connector may prevent gases from escaping from the antenna to the atmosphere when the antenna is used, for example, in level gauging applications.

Except as described herein, operation of mode converter 110 is substantially similar to operation of mode converter 10. Apertures 150 are structured and configured and perform substantially as described herein with regard to apertures 50.

The following patents and publications provide some indication of the state of the relevant art. These documents are as follows Okano et al. U.S. Patent Application Publication 2007/0075801; Paynter U.S. Patent Application Publication 2008/0136565; Zinger et al. U.S. Pat. No. 4,628,287; Saad et al. U.S. Pat. No. 4,553,112; Chambelin et al. U.S. Patent Application Publication 2003/0080828; Waaren U.S. Pat. No. 5,515,673; Rosenberg GB2434922; Holzman U.S. Patent Application Publication 2003/0174097; Rofougaran U.S.

patent Application Publication 2012/0077447; Den U.S. Pat. No. 3,646,481; Irzinski et al. U.S. Pat. No. 4,679,008; Gans et al. U.S. Pat. No. 4,914,443; Moeller et al. U.S. Pat. No. 5,030,929; Webb et al. U.S. Pat. No. 6,424,764; and Ziegner et al. U.S. Pat. No. 6,573,803. Each of these documents is incorporated in its entirety by reference herein.

While the present invention has been described with respect of various specific examples and embodiments; it is to be understood that the invention is not limited thereto and that it may be variously practiced within the scope of the following additional disclosure in claim format.

What is claimed is:

1. A wave mode converter to convert rectangular TE10 waveguide mode to circular TE01 waveguide mode, the converter comprising:

a radial waveguide structured to receive a radially propagating field derived from the rectangular TE10 waveguide mode, the radial waveguide comprising a generally disk-shaped structure having a first surface and an opposing second surface, and a body having a body surface substantially adjacent the second surface and including a plurality of spaced apart apertures.

2. The wave mode converter of claim 1, wherein the plurality of spaced apart apertures form a ring of apertures.

3. The wave mode converter of claim 2, wherein the ring of apertures are located substantially around a center of the radial waveguide.

4. The wave mode converter of claim 1, wherein the plurality of spaced apart apertures are present in a substantially circular array.

5. The wave mode converter of claim 1, wherein each of the apertures is shaped substantially identically.

6. The wave mode converter of claim 1, wherein the plurality of spaced apart apertures are parabolic apertures.

7. The wave mode converter of claim 6, wherein each of the parabolic apertures is radially oriented in substantially the same direction relative to a center of the radial waveguide.

8. The wave mode converter of claim 6, wherein the plurality of spaced apart parabolic apertures are structured to create a unified resultant electric field vector that circulates in the direction of the foci of the parabolas formed by the plurality of parabolic apertures.

9. The wave mode converter of claim 1, wherein the generally disk-shaped structure has a generally circular peripheral configuration.

10. The wave mode converter of claim 1, wherein the generally disk-shaped structure includes an outer surface, and the wave mode converter further comprises an outer absorber member in contact with the outer surface and structured to substantially prevent reflected waves from occurring.

11. The wave mode converter of claim 1, which further comprises a field expansion assembly that couples a circular waveguide TE01 mode from the radial waveguide to a larger overmoded circular waveguide substantially without generation of higher modes.

12. The wave mode converter of claim 11, wherein the field expansion assembly comprises a conical section positioned in proximity to the radial waveguide.

13. The wave mode converter of claim 12, wherein the conical section comprises two concentric cones.

14. The wave mode converter of claim 12, wherein the conical section is effective in generating and receiving circular TE01 fields and in allowing the conversion of circular TE01 mode to rectangular TE10 mode.

15. The wave mode converter of claim 1, which further comprises:

a waveguide chamber comprising a shorted center conductor effective to convert rectangular TE10 waveguide to coaxial TEM mode.

16. The wave mode converter of claim 15, wherein the shorted center conductor comprises a screw with an O-ring seal.

17. The wave mode converter of claim 1, wherein the generally disk-shaped structure of the radial waveguide comprises a dielectric material.

18. The wave mode converter of claim 1 which further comprises a SMA connector positioned to directly drive the radial waveguide.

19. The wave mode converter of claim 1 which further comprises a radome sized, positioned and effective to provide protection against moisture and contaminants entering the plurality of apertures.

20. A method of forming circular TE01 waveguide mode comprising using the wave mode converter of claim 1 to convert rectangular TE10 waveguide mode to circular TE01 waveguide mode.

* * * * *